United States Patent [19]

Kahelin

[11] 4,423,717

[45] Jan. 3, 1984

[54] VARIABLE DOUBLE WHEEL BALL PROPELLING MACHINE

[76] Inventor: Edward W. Kahelin, 15701 Container La., Huntington Beach, Calif. 92649

[21] Appl. No.: 160,116

[22] Filed: Jun. 16, 1980

Related U.S. Application Data

[63] Continuation of Ser. No. 914,528, Jun. 12, 1978, abandoned.

[51] Int. Cl.[3] ..... F41B 15/00

[52] U.S. Cl. ..... 124/78; 273/26 D

[58] Field of Search ..... 124/78, 79, 81; 273/26 D

[56] References Cited

U.S. PATENT DOCUMENTS 2,729,206 1/1956 Wilson ..... 124/78

4,086,903 5/1978 Scott ..... 124/78

OTHER PUBLICATIONS

"Pitch All"-Ken's Tool & Design, Inc., 740 E. Davis, Sullivan, Ind. 47882.

*Primary Examiner*—Richard J. Apley

*Assistant Examiner*—William R. Browne

*Attorney, Agent, or Firm*—George W. Finch

[57] ABSTRACT

An improved apparatus for propelling balls such as baseballs and softballs with accurate and predetermined spins, speeds and placements which includes a pair of opposed spinning wheels, a guide to insert the ball to be thrown between the wheels and a motor which by means of a belt and pulleys, drives the two wheels at least at two predetermined ratios or speeds to impart the proper motion to the ball. The wheels are mounted so that the distance therebetween can be adjusted for balls of different diameters. A base is also included which optionally may include pivot means so that the plane of rotation of the spinning wheels can be rotated about the path of the ball to change the direction of the spin on the thrown ball and an automatic feed mechanism.

9 Claims, 10 Drawing Figures

VARIABLE DOUBLE WHEEL BALL PROPELLING MACHINE

This is a continuation of copending patent application Ser. No. 914,528, filed June 12, 1978 now abandoned.

BACKGROUND OF THE INVENTION

There are many machines for throwing balls through the use of opposed spinning wheels. Examples include WILSON, U.S. Pat. No. 2,729,206; DOEG, U.S. Pat. No. 2,918,915; YARUR et al., U.S. Pat. No. 3,913,552; HALSTEAD U.S. Pat. No. 3,724,437; and BETTEN, U.S. Pat. No. 3,811,421 which were cited in copending patent application Ser. No. 800,356, entitled OPPOSED WHEELS BALL PROPELLING MACHINE, by Edward W. Kahelin et al. Some like Yarur et al, Halstead and Betten suffer because they use a motor for each wheel, the speed of which must be carefully controlled for accuracy of the throw. The second motor is also a major expense item in the construction of double wheel ball propelling devices. The single motor belt driven double wheel ball throwing machines such as Wilson and Doeg have needlessly complex belt drive mechanisms, no facility to change the relative speed ratios between wheels, and no means to accommodate balls of different diameters conveniently in the field. In the case of Doeg, a relatively soft ball such as a tennis ball is required due to the spin imparting mechanism employed.

The end result is that in the prior art there are no machines which can consistently throw baseballs and softballs at the desired velocities and spins and from the proper level above the ground so that the various pitches which occur during a game can be simulated with enough accuracy for safety. Most prior art machines require almost constant monitoring for safety especially when throwing at high velocities. This makes them unsuitable in commercial establishments where the operator desires to have a plurality of batting cages that require no supervision. It is also disadvantageous at the team level since the prior art machines require a skilled coach or operator.

SUMMARY OF THE PRESENT INVENTION

The present invention is an opposed double wheel machine. The wheels are preferably those manufactured for such purpose by the Goodyear Tire and Rubber Co. which have been commercially available for a number of years and which are very similar to treadless house trailer tires. The opposed wheels are driven by a belt drive including stepped pulleys which make at least two drive ratios or speeds available. In the embodiment for commercial establishments, a constant speed continuous duty motor is employed and the speeds and/or spin ratio is adjustable only by moving the belt on the stepped pulleys. A batter wishing to see different kinds of pitches usually must move from batting cage to batting cage yet the machine in any cage can be quickly converted to throw any desired pitch.

For the team embodiment, a variable speed motor is used with a double stepped pulley arrangement so that two spin ratios, one for fast balls and the other for curves are available. The speed of such pitches is varied by control of the variable speed motor. It has been found by the applicant that two spin ratios in combination with pivoting means which allow the plane of rotation of the two wheels to be rotated, generally about the path of the propelled ball and the variation in speed available allows the simulation of all pitches normally thrown except knuckle balls. Knuckle balls can be thrown by including third steps on the pulleys so that no spin is imparted to the ball. The throwing of knuckle balls is not encouraged, however, since they are propelled with essentially no stabilizing spin and therefore may change directions in flight in such a manner as to be dangerous to the nonskilled better. The team embodiment also includes folding legs which allow the machine to be transported by using the legs as handles and by using one of the wheels like the wheel on a wheelbarrow. Additionally, the bearings for the wheels are mounted on eccentric pivots so that the space between the wheels can be changed easily in the field and through the use of different legs and ball chutes the machine can be quickly converted from propelling baseballs to softballs. The present machines are also adaptable to automatic ball feed mechanisms such as that shown in the applicant's above referenced patent application. However such are normally used only with commercial type machines.

It is therefor an object of the present invention to increase the accuracy of opposed wheel ball propelling machines while retaining the capability of throwing any kind of pitch.

Another object is to provide a single machine for propelling balls such as baseballs and softballs with accurate spin, direction and speed into a strike zone.

Another object is to provide a versatile and safe ball propelling machine which is relatively economical to manufacture and requires very little maintenance.

Another object is to provide a portable ball propelling machine which is light enough to be easily handled by one person and which can be transported in the trunk of a full size car.

Another object is to provide a baseball and softball propelling machine which has the capability of taxing the very best player while being useful in the initial training of neophytes.

These and other objects and advantages of the present invention will become apparent to those skilled in the art after considering the following detailed specification which covers preferred embodiments of the present invention in conjunction with the accompanying drawings wherein:

DETAILED DESCRIPTION OF THE PRESENT EMBODIMENTS

Figure 1:
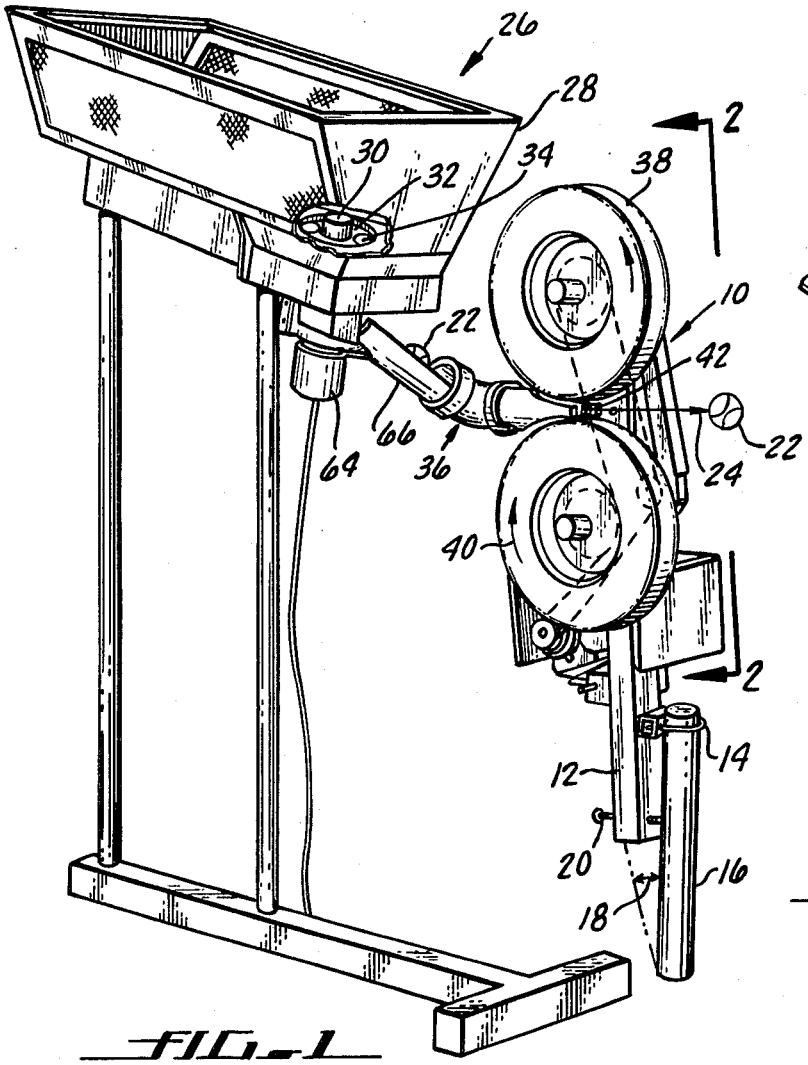
FIG. 1 is a perspective view partially cutaway of the commercial version of the present invention showing it as it exists in commercial batting practice establishments.

Referring to the drawings more particularly by reference numbers, number 10 in FIG. 1 refers to a variable double wheel ball propelling machine constructed according to the present invention. The machine 10 which is the embodiment designed to throw pitches of varying speed but with the ball spin axis of a fast ball so that a stable accurate flight of the ball is maintained throughout the operating day. The machine 10 includes a base member 12 which is moveably attached by suitable means such as the U bolt 14 to a pipe or stanchion 16 which forms a portion of the permanent installation of the batting cage in which such machines are normally installed. The angle 18 between the base 12 and the pipe 16 is maintained and adjusted by a bolt 20 which threadably engages the base 12 and bears against the pipe 16. The center of gravity of the machine 10 is behind the pivot 14 so the machine 10 tends to maintain forceful connection of the bolt 20 with the pipe 16. The forces associated with propelling the ball also maintain this force. Adjustment of the angle 18 changes the elevation of the flight of the ball 22 as indicated by the arrow 24 so that the propulsion direction can be varied for the various speeds the machine 10 is capable of imparting to the ball, the size of the batter and the desired vertical position of the ball within the strike zone as established by the size of the batter.

Since the present machine 10 is extremely accurate in propelling balls at the same speed and direction for hours at a time, normally vertical path and speed adjustment is made when the machine is initially installed and thereafter batters use batting cages having machines adjusted to their particular requirements.

As shown, the installation may also include an automatic ball feeder 26 which includes a hopper 28, and an automatic ball feeding device 30 of the type shown in copending U.S. patent application Ser. No. 800,356. The device 30 includes a carousel 32 having a plurality of baseball size passageways 34 which extend therethrough, a plate (not shown) below the carousel also includes baseball sized orifices and when the holes 34 match with the orifice a ball is allowed to drop into a chute 36 for feeding the machine 10. The chute 36 feeds the ball 22 into the area between a pair of spinning sheels 38 and 40 which are spun by drive means in the direction of the arrows thereon. The wheels 38 and 40 are pneumatic tires specially manufactured for such use by the Goodyear Tire and Rubber Co. and the spacing 42 is slightly less than the diameter of the ball 22 to be propelled so that the wheels engage the ball 22 and accelerate it in the direction of arrow 24. It is preferable that one wheel such as wheel 40 be rotated faster than the other so that spin is imparted to the ball which stabilizes its flight and makes the ball propelling machine 10 more accurate.

Figure 2:
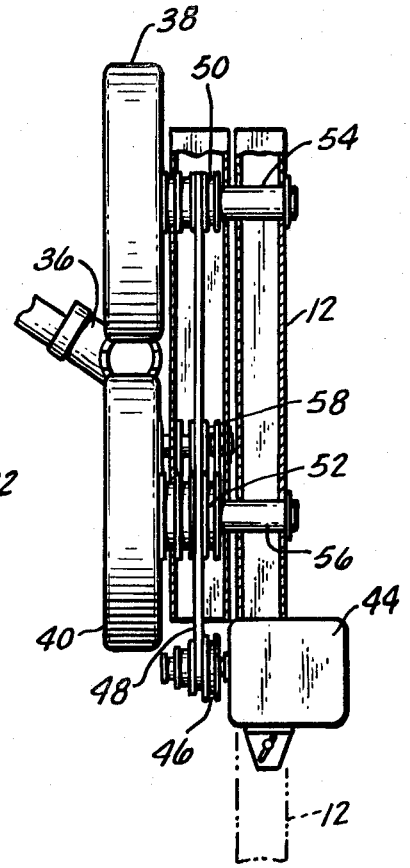
FIG. 2 is a cross-sectional view taken on line 2—2 in FIG. 1.
Figure 3:
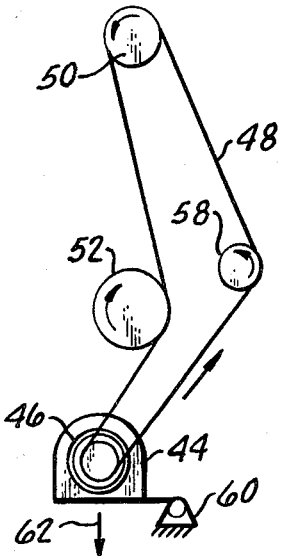
FIG. 3 is a diagrammatic view showing the drive mechanism for the ball propelling machine of FIGS. 1 and 2.

The wheels 38 and 40 are spun by a drive motor 44 shown more clearly in FIGS. 2 and 3. The drive motor 44 includes a stepped pulley which by means of a belt 48 drives pulleys 50 and 52 which are connected to the wheels 38 and 40 respectively. It is usual that the pulleys 50 and 52 and the wheels 38 and 40 are supported on bearings not shown, to shafts 54 and 56 firmly attached to the base 12. The drive mechanism is more clearly understood by reference to FIG. 3.

As can be seen, the belt 48 loops about the stepped pulley 46, the drive pulleys 50 and 52 and an idler wheel 58. The tension within the belt 48 is maintained on the pulleys and the idlers by mounting it on a pivot 60 so that the weight of the motor 44 acts in the direction of arrow 62. The belt 48 is easily moveable along the stepped pulley 46 to change the rotational speed of the wheels 38 and 40 by merely lifting the motor 44 about the pivot 60 until the belt 48 loosens and then by moving the belt 48 to the portions of pulleys giving the desired speed. It should be noticed that the diameters of pulleys 50 and 52 do not change as the belt is shifted laterally along the different diameters of the step pulley 46, yet pulley 52 is slightly larger than pulley 50. This is to establish a rotational difference between the wheels 38 and 40 so that aforementioned spin is imparted to the ball 22 to stabilize it. Like the team embodiment to be discussed later, the pulleys 50 and 52 can be stepped if it is desired to change spin versus speed ratio.

The simple belt drive shown allows adjustment of the speed of the machine easily and quickly without affecting the accuracy of the machine in propelling the ball in the desired direction, day in and day out. For this reason once the machine is installed, the motor 44 can be turned on as the batting establishment opens, thereafter one wishing to use the machine usually is provided with a coin operated control which turns on motor 64 (FIG. 1) to rotate the carousel 32 a predetermined number of times and thereby feed a predetermined number of balls 22 into the machine for propulsion towards the batter. The batter is given visual clues as to when a ball is to be propelled by observance of an open portion 66 of the chute 36 which is provided so that the motion of a ball 22 can be seen as it travels therealong.

The team type machine 70 is shown in FIGS. 4 through 10. The commercial machine 10 is designed for accurate and reliable day in and day out propelling of a ball in a given direction whereas the team machine 70 is designed to be portable and more versatile so that it can be used to throw pitches of various types at various speeds and also to propel balls of different diameters from different height locations thereby being above to simulate pitches as seen by a baseball or a softball batter. The machine 70 includes front legs 72 and rear legs 74 of proper height so that the ball 22 is propelled from a location above the earth similar to that established when the ball is thrown by a human pitcher. The legs 72 and 74 are removeably connected to base members 76 and 78 respectively and are restricted from outward movement by chains 80 and 82 connected therebetween. The front legs 72 include base plates 84 since it is the front legs 72 which maintain the position of the machine 70 whereas the rear legs 74 merely support the machine to establish the vertical angle of the ball path 85.

Figure 5:
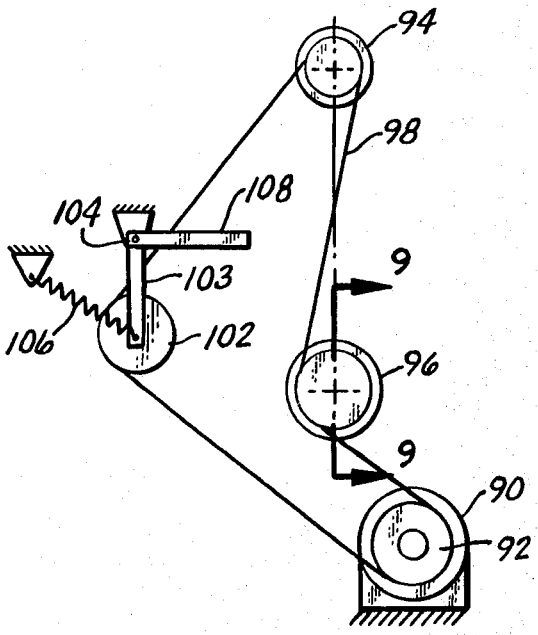
FIG. 5 is a diagram of the drive mechanism of the machine of FIG. 4.
Figure 4:
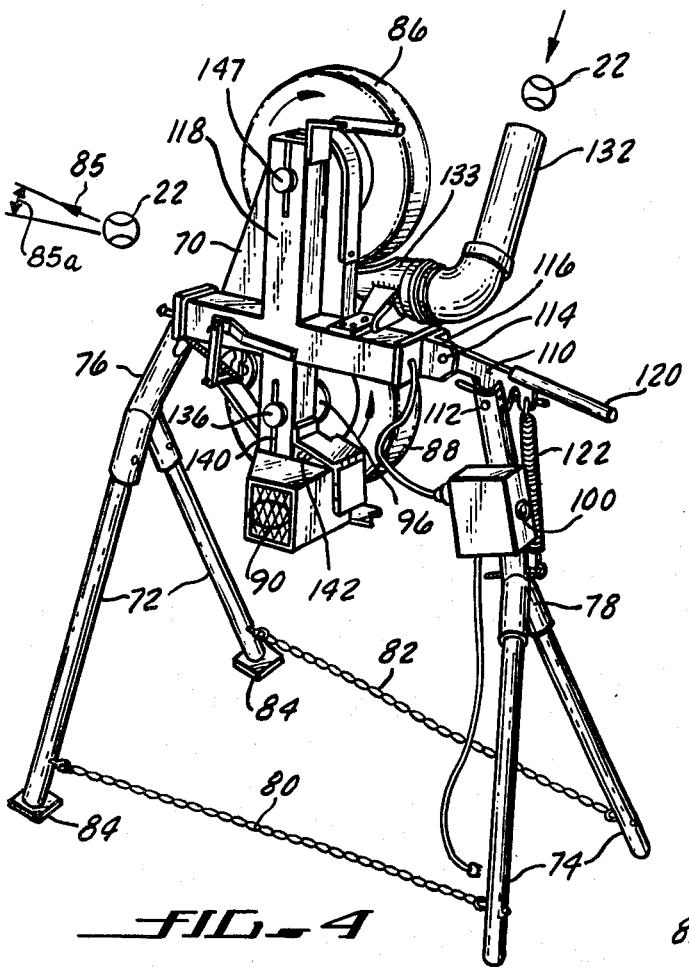
FIG. 4 is a perspective view from the left rear of the team embodiment of the present ball propelling invention.

The machine 70 includes a pair of opposed wheels 86 and 88 of the type described for the machine 10 which are spun in the indicated direction by means of a variable speed motor 90, the drive means for the wheels 86 and 88 being diagrammatically shown in FIG. 5. The motor 90 includes a pulley 92 which has at least two belt locations thereon but unlike pulley 46, may be of the same diameter. The drive pulleys 94 and 96 which connect to the wheels 86 and 88 respectively are stepped with predetermined diameters so that when the belt 98 driving them is moved laterally from one position to the other, the relative spin ratio of the two wheels is changed. Although various ratios are possible and since pitchers commonly impart spin to a ball in relationship to the velocity at which it is thrown, the Applicant has discovered that two ratios, one for fast balls and another for curves are sufficient to simulate all the pitches presently being thrown with the exception of knuckles balls which, because of safety considerations, are not desirable. The speed variation of the pitches is accomplished by changing the speed of the motor 90 by means of a variable speed control 100 (FIG. 4).

The remainder of the drive mechanism of machine 70 differs from the mechanism as shown in FIG. 3 only in that the idler wheel 102 is mounted on a lever 103 about a pivot 104 and is force loaded by means of a spring 106 to maintain the belt 98 in tension. A handle 108 is provided on the lever 103 so that the idler wheel 102 can be moved easily to relieve the belt tension and facilitate movement of the belt from one pulley ratio to the other. Such a drive mechanism in combination with the other features of the team machine 70 to be described assures accurate, consistent propelling of the ball, a necessary requirement to produce successful results when training batters.

Figure 7:
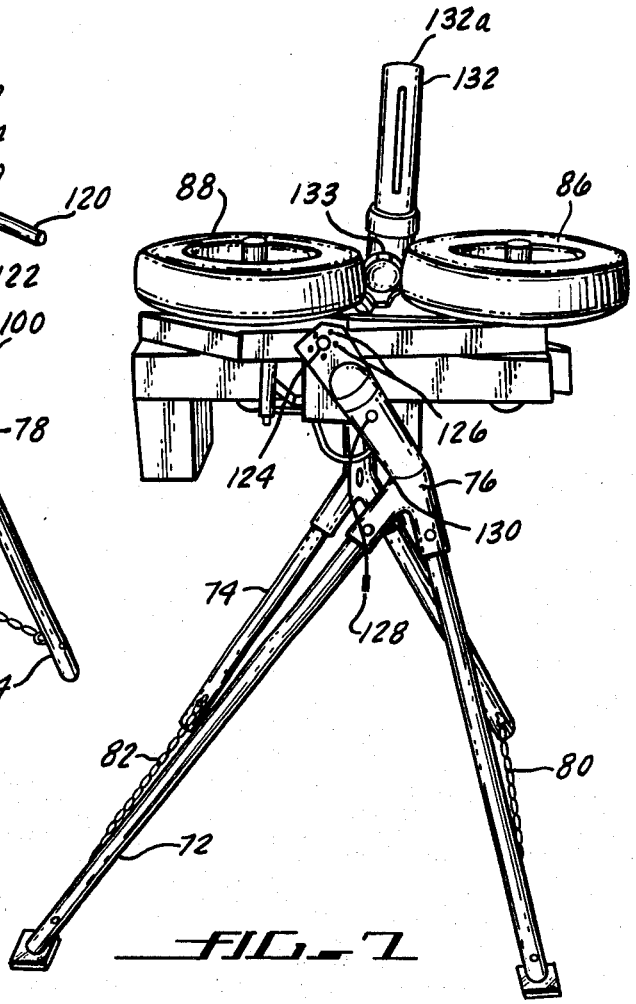
FIG. 7 is a front perspective view of the team machine of FIGS. 4 and 5 adjusted to throw curves with baseballs.

The initial vertical angle 109 at which the ball 22 is propelled is controlled by adjusting the machine 90 along the vertical plane. This is accomplished by means of a lever 110 (FIGS. 5 and 10) which is mounted by means of pivot 112 to the leg support 78 and by pivot 114 to an L member 116, connected to the main cross member 118. The main cross member 118; and with is connected motor 90 and wheels 86 and 88 is supported for rotational adjustment about front and rear pivots 124 and 125 as shown in FIG. 7. This allows side and top spins to be imparted to the ball. Various angles can be accurately established by means of indexing holes 126 in the front leg support 76 which then aligned with a hole on the adjacent cross member 118 and pinned by means of cable retained pin 128, maintains the machine in the desired rotated position. It should be noted in FIG. 7 that the support 76 is in the form of a crooked, inverted Y, the crook 130 being provided so that when the cross member 118 is rotated approximately 200° from the position shown, to provide top spin, the ball 22 can be propelled therefrom without hitting the support member 76. A variable tension member such as hose clamp 131 is used to retain the jointed chute 132 in a nearly vertical position so that balls dropped in the top 132*a* thereof travel therealong for insertion beteen the spinning wheels 86 and 88. The chute 132 is adjusted to vertical after the desired angle of the cross member 118 has been established. A slot 132*b* is provided therein facing the batter so that the batter can see when a ball 22 is going to be propelled. The outlet of the chute 132 has a forked guide 133 which is circular in cross section and is relieved top and bottom to just clear the wheels 86 and 88.

Figure 8:
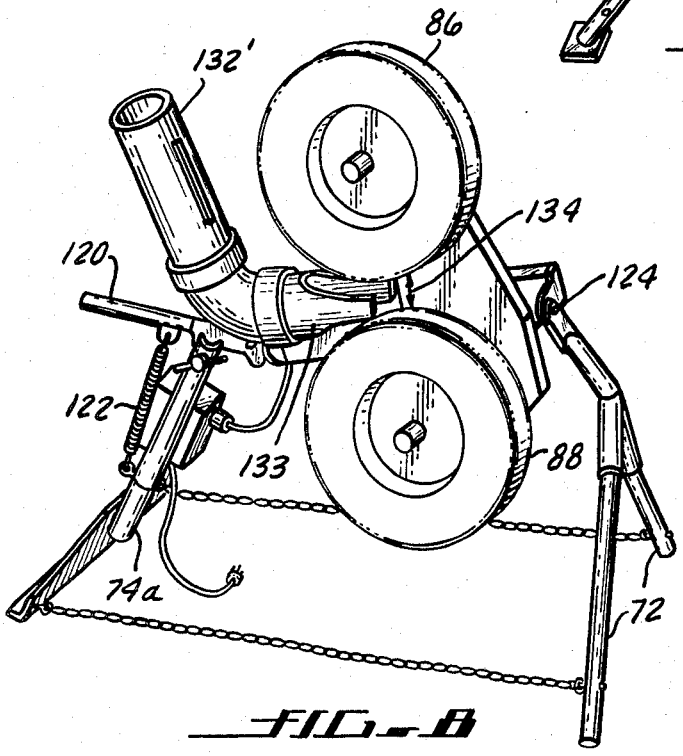
FIG. 8 is a right side perspective view of the machine of FIGS. 4 through 7 configured to pitch softballs.
Figure 6:
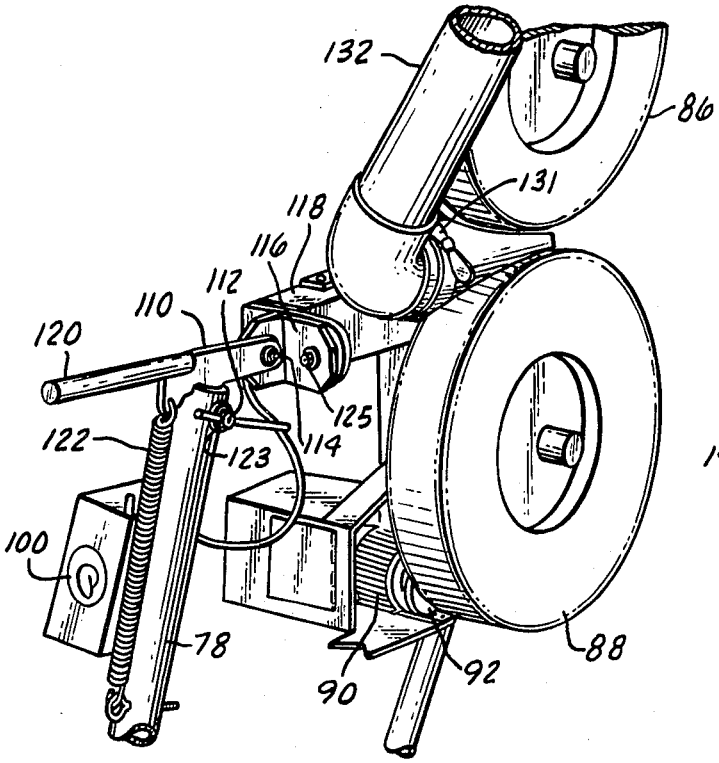
FIG. 6 is an enlarged perspective view of the left rear of the machine of FIG. 4 showing the detail of the elevation control and the spin axis control.
Figure 9:
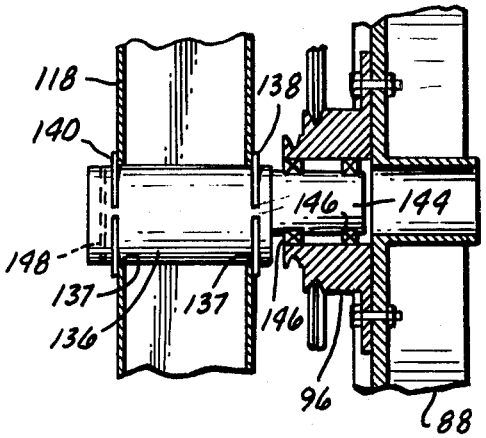
FIG. 9 is a cross-sectional view taken at line 9—9 in FIG. 8 showing the ball size adjustment mechanism of the present invention.

FIG. 8 is the machine of FIG. 7 with a larger ball chute 132' and guide 135' capable of guiding softballs between the two rotating wheels 86 and 88. FIG. 8 shows shorter legs 72*a* and 74*a* which lower the machine 70 so that it simulates the throw of an underhanded softball pitcher. For slow pitch softball, the baseball front leg 72 is used so the ball lobs to the batter. Of course, to propel a softball, the distance 134 between the wheels 86 and 88 must be increased. This is accomplished by the mechanism shown in FIG. 9 wherein the detail of the support for wheel 88 and pulley 96 is amplified. As shown, a shaft 136 is supported in a hole 137 in the cross member 118 by split rings 138 and 140 which prevent lateral movement thereof and frictional forces provided by a slot 140 which squeezed about the shaft 136 by means of bolts 142 (FIG. 4). The shaft 136 includes a bearing supporting extension 144 which is eccentric to the main portion of the shaft 136. The eccentric portion 144 and bearings 146 thereon which support the pulley 96 and the wheel 88 can be moved with respect to the other shaft 147 which has similar means by loosening the bolts 142 and placing a key in a hole 148 provided in the shaft 136 for that purpose. Both wheels are supported in this manner so that it is possible to move the wheels apart or closer together a distance which is twice the amount of eccentricity between the shaft 136 and the portion 144 by rotating the shafts 136 and 147 180°. The spring loaded idler wheel 102 automatically makes up the difference in the belt drive system. This and a chute size and leg change allows the machine 70 to be quickly converted to pitch either baseballs or softballs. This positive and accurate method of positioning the wheels yet making them adjustable is still another reason why the present machine out performs competitive machines in accuracy and repeatability.

Figure 10:
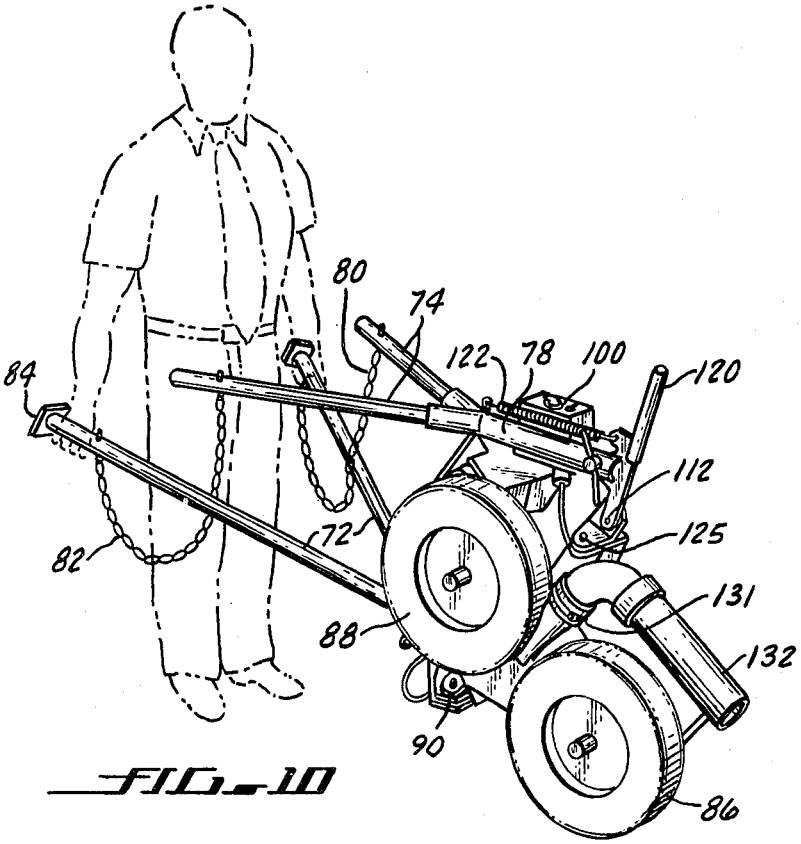
FIG. 10 is a perspective view of the present invention folded and inverted for case of transport.

FIG. 10 is a pictorial view showing how by folding of the legs at the divided pivots and inverting the machine 70 the upper wheel 86 can be used like the wheel on a wheel barrow so that the machine 70, which is relatively light, can be transported about the field or to a car or truck for transportation to another location.

Thus there has been shown and described novel ball propelling devices which fulfill all of the objects and advantages sought therefor. Many changes, modifications, variations, other uses and applications of the subject invention will, however, become apparent to those skilled in the art after considering this specification and the foregoing specification together with the accompanying drawings and claims. All such changes, modifications, variations other uses and applications which do not depart from the spirit and scope of the invention are deemed to be covered by the invention which is limited only by the claims which follow.

What is claimed is:

1. A machine for propelling balls of at least two different diameters with accurate speed, direction and spin including:

a body;

means for supporting said body in an adjustable manner with respect to the ground;

a pair of opposed wheel assemblies;

adjustable support means connected to said body and supporting said wheel assemblies so that at least two predetermined spaces being less than the diameter of one of the balls and the other predetermined space being less than the diameter of the other ball;

means to rotate said wheel assemblies in opposite directions with at least one predetermined spin ratio therebetween; and means to guide a ball to be thrown into said predetermined space for frictional engagement with said rotating opposed wheel assemblies for propulsion thereby, said means to guide a ball including:

a ball inserter positioned between said wheel assemblies, said inserter being generally cylindrical in shape and having an inlet end and an outlet end, said outlet end including concave cutouts on opposite sides thereof to provide clearance for said wheel assemblies;

a ball chute being generally cylindrical in shape and having a portion spaced from said wheel assemblies and facing the direction of ball propulsion removed therefrom so that a ball moving therethrough can be observed by a person at whom the ball is going to be propelled so that the person can anticipate the propulsion of the ball; and connector means adjustably connecting said ball chute to said ball inserter so that said ball chute can be maintained at an orientation which causes gravity to move the balls toward said ball inserter no matter the orientation of said body, said means to rotate said wheel assemblies further including:

an electric motor having at least first and second pulley outputs;

a first pulley assembly having at least first and second inputs and being connected to one of said opposed wheel assemblies;

a second pulley assembly having at least first and second inputs and being connected to the other of said opposed wheel assemblies, said first pulley output of said electric motor being in alignment with said first pulley inputs of said first and second pulley assemblies and said second pulley output of said electric motor being in alignment with said second pulley inputs of said first and second pulley assemblies; and a drive belt threadable about each of said aligned pulley inputs and output, said drive belt being threadable about said motor pulley and one of said pulley assemblies in a first rotative direction and about the other pulley assembly in the opposite rotative direction, each of said aligned pulley inputs and outputs providing a different rotative speed to said wheel assemblies when said electric motor speed is the same.

2. The machine defined in claim 1 wherein said inputs of at least one of said pulley assemblies have different diameters so that said wheel assemblies can be driven with at least two predetermined spin ratios.

3. A machine for propelling balls of at least two different diameters with accurate speed, direction and spin including:

a body;

means for supporting said body in an adjustable manner with respect to the ground;

a pair of opposed wheel assemblies, each including means for frictional engagement with a ball to be propelled;

adjustable support means connected to said body and supporting said wheel assemblies so that at least two predetermined spaces can be chosen therebetween, one of said two predetermined spaces being less than the diameter of one of the balls and the other predetermined space being less than the diameter of the other ball;

means to rotate said wheel assemblies in opposite directions with at least one predetermined spin ratio therebetween, generally said wheel assemblies rotating in a common plane; and means to guide a ball to be thrown into said predetermined space for frictional engagement with said rotating opposed wheel assemblies for propulsion in a predetermined direction said means for supporting said body in an adjustable manner with respect to the ground including:

pivot means having a pivot axis generally aligned with said predetermined direction of ball propulsion, whereby said pivot means allow tilting of said wheel assembly plane of rotation at least 90° so that the direction of spin of the propelled ball can be adjusted substantially with respect to the ground.

4. The machine defined in claim 3 wherein said means for supporting said body in an adjustable manner with respect to the ground include:

front legs mounted to said pivot means;

rear legs; and a link having an elevation handle thereon, pivotally connected to said rear legs and said pivot means so that the vertical path of the propelled ball can be adjusted by movement thereof.

5. The machine defined in claim 4 wherein said pivot means have pivot lock means including:

a pin; and mating pin receivers on said body and said front legs positioned so that when said pin is inserted therein, rotation between said body and said front legs is prevented.

6. The machine defined in claim 4 wherein said front and rear legs include lower leg portions which are removable whereby lower leg portions of different lengths can be substituted to adjust the initial elevation of a propelled ball.

7. The machine defined in claim 4 wherein said front legs are in general alignment with said wheel assemblies so that at least one of said wheel assemblies can be pivoted to extend away from said front legs so that said wheel assembly and front legs can be used wheelbarrow fashion to move said extended away machine.

8. The machine defined in claim 4 including restraint means connected between said front and rear legs to restrict the distance said legs can be moved apart at their lower extremities.

9. A machine for propelling balls of at least two different diameters with accurate speed, direction and spin including:

a body;

means for supporting said body in an adjustable manner with respect to the ground;

a pair of opposed wheel assemblies;

adjustable support means connected to said body and supporting said wheel assemblies so that at least two predetermined spaces can be chosen therebetween, one of said two predetermined spaces being less than the diameter of one of the balls and the other predetermined space being less than the diameter of the other ball;

means to rotate said wheel assemblies in opposite directions with at least one predetermined spin ratio therebetween; and means to guide a ball to be thrown into said predetermined space for frictional engagement with said rotating opposed wheel assemblies for propulsion thereby, said adjustable support means further including:

a first axle for rotatably supporting one of said wheel assemblies; and a first shaft directly connected eccentrically to said first axle and manually rotatable with respect to said body on which said first shaft is mounted, whereby rotation of said first shaft changes the space between said wheel assemblies, wherein said adjustable support means include:

a second axle for rotatably supporting the other of said wheel assemblies; and a second shaft connected eccentrically to said second axle and manually rotatable with respect to said body on which said second shaft is mounted, and wherein said body includes:

frictional lock means to prevent unwanted rotation of said first and second shafts.

* * * * *